US006929017B2

(12) United States Patent
Byun

(10) Patent No.: US 6,929,017 B2
(45) Date of Patent: Aug. 16, 2005

(54) COLLAPSIBLE CANOPY FRAMEWORK STRUCTURE OF A REGULAR POLYGON

(76) Inventor: Taewoong Byun, 215-1202 Hanjin apt., 616-100, Donam-dong, Seongbook-gu, Seoul 136-060 (KR)

( * ) Notice: Subject to any disclaimer, the term of this patent is extended or adjusted under 35 U.S.C. 154(b) by 283 days.

(21) Appl. No.: 10/282,254

(22) Filed: Oct. 29, 2002

(65) Prior Publication Data

US 2004/0079406 A1 Apr. 29, 2004

(51) Int. Cl.[7] ..... E04H 15/50

(52) U.S. Cl. ..... 135/145; 135/139; 135/151; 135/131

(58) Field of Search ..... 135/131, 135, 135/139, 143–145, 147, 151, 120.4; 52/641, 643, 646, 109; 403/122, 141

(56) References Cited

U.S. PATENT DOCUMENTS

| | | | | | |
|---|---|---|---|---|---|
| 2,799,286 | A | * | 7/1957 | Nordmeyer | 135/123 |
| 4,558,713 | A | * | 12/1985 | Hagler et al. | 135/159 |
| 4,607,565 | A | | 8/1986 | Sugawara et al. | 98/40.24 |
| 4,607,656 | A | | 8/1986 | Carter | 135/110 |
| 4,641,676 | A | | 2/1987 | Lynch | 135/110 |
| 4,779,635 | A | | 10/1988 | Lynch | 135/97 |
| 4,947,884 | A | | 8/1990 | Lynch | 135/97 |
| 5,244,001 | A | | 9/1993 | Lynch | 135/103 |
| 5,421,356 | A | * | 6/1995 | Lynch | 135/145 |
| 5,490,533 | A | * | 2/1996 | Carter | 135/145 |
| 5,794,640 | A | * | 8/1998 | Jang | 135/131 |
| 5,944,040 | A | * | 8/1999 | Jang | 135/126 |
| 6,206,020 | B1 | | 3/2001 | Lynch | 135/128 |
| 6,374,843 | B1 | * | 4/2002 | Zou | 135/145 |
| 6,470,902 | B1 | * | 10/2002 | Carter | 135/145 |
| 6,598,614 | B2 | * | 7/2003 | Liu | 135/131 |
| 6,708,707 | B2 | * | 3/2004 | Dotterweich et al. | 135/131 |
| 6,725,873 | B2 | * | 4/2004 | Liu | 135/145 |

* cited by examiner

*Primary Examiner*—Winnie Yip
(74) *Attorney, Agent, or Firm*—Fleshner & Kim, LLP

(57) ABSTRACT

A collapsible canopy framework structure of a regular polygon comprises a plurality of supporting members and a center post, which are constituted as a column. A plurality of first frame assemblies comprises at least one frame unit with a pair of frames being pivoted in an X shape at their center to each other, in which the first frame assembly is mounted between the supporting member and the center post. The third frame assembly comprises at least one frame unit to be mounted between the supporting members to secure the gaps between the supporting members and provide a structural reinforcement to the upper portion of an overall structure. At least one flexible string is passed through the cross-points of the frame units of the first frame assembly on which a block nut structure is mounted and then fixed into the block nut structure to form a regular polygon of the supporting members and give a tension to the overall structure. The collapsible canopy framework structure can be set up against the upper and lateral loads, thereby preventing the twist of the collapsible canopy framework structure.

7 Claims, 7 Drawing Sheets

COLLAPSIBLE CANOPY FRAMEWORK STRUCTURE OF A REGULAR POLYGON

BACKGROUND OF THE INVENTION

The invention is related to providing a collapsible canopy framework, and particularly, to providing a collapsible canopy framework structure of a regular polygon including upper frameworks reinforced to effectively support the loads of its upper and sides and to be easily collapsible and expandable.

PRIOR ART

In general, portable & temporary shelters can be easily transported and rapidly set up at emergency sites to provide an emergency care and housing. Such shelters can also be useful for non-emergency outdoor gatherings, such as temporary military posts, field trips, sports events and the like. The temporary shelters are quickly erected and folded, which includes a framework of X-shaped linkages or scissors assembly, telescoping legs or leg assembly, and a canopy or tent covering the framework.

A typical technologies of this field are disclosed as a canopy framework structure in U.S. Pat. No. 6,206,020 to U.S. Pat. No. 4,641,676 issued to Mr. Lynch, which are similar to U.S. Pat. No. 4,607,565 issued on Aug. 26, 1986 to Mr. Carter in the last ten years.

The canopy framework structure of the '676 patent includes a plurality of upright support members which are a plurality of scissors assemblies. The scissor assemblies have their upper outer ends fastened to the upright support by removable. Internal scissors assemblies may be provided to support a central post, and a covering extend s in a dome-like manner. But, the scissor assembly in these two structures are under the compressive pressure. When the scissor assemblies are subject to force transversely of their plane, the combination of this force with the compressive pressure can result in substantial bowing of the scissor assemblies and distortion of the canopy framework.

The improvement of the structure of the '676 patent is disclosed in U.S. Pat. No. 4,779,635 issued on Oct. 15, 1988, but a canopy structure outwardly biases its corner support members so that the framework interconnecting the adjacent corner support members is placed in tension opposed to compression. Nevertheless, the assembly is only related to the scissor bar interconnections without enhancing the stability of scissoring canopy framework.

For it, a canopy framework structure, which is disclosed in U.S. Pat. No. 5,244,001 issued on Sep. 14, 1993, adapts socket-type mounts to fasten the ends of the scissor assemblies to the upright supports and to each other. The socket is formed to have spaced-apart, parallel sidewall portions. The end scissor assemblies have outer end portions of rectangular cross-section so that each can be received in a closed-fitted engagement between the parallel sidewall portions, thereby forming planar contact surfaces. The socket simplifies interconnection of various structural members, but at the same time provides resistance to lateral forces.

Despite the improvements, there remains a need for improved framework structures that provide quick erect canopy shelters. The canopy framework structure utilizes one stationary mount and one slide mount on the upright supports. The use of the slide mount is necessary to allow a pair of upper and lower outer ends of the scissor assemblies to move apart from one another, thereby allowing the scissor assemblies to move between the expanded state and the collapsed state. In other words, edge scissor assemblies including a pair of scissor units pivoted at one ends to each of the stationary and slide mounts are interconnected by floating brackets at their other ends between support members. Inner scissor assemblies are pivoted at one ends to the floating mounts of the edge scissor assemblies and at the other ends to each of a stationary mount and a slide mount in order to secure a predetermined space between the supporting members and a center post.

In order to eliminate the need for the more improved framework structure, U.S. Pat. No. 6,206,020 entitled "A Collapsible Canopy Framework Structure" discloses an articulating section constituted as a part of a scissor assembly including a plurality of scissor arms. The articulating sections are pivotally connected at their ends to each of articulating brackets or mounts and a lower stationary mount of the supporting member to be folded and expanded therebetween.

The collapsible canopy framework structure also comprises a plurality of edge scissor assemblies making interconnection between supporting members to form the circumferential portion of a canopy shelter and a plurality of inner scissor assemblies interconnected between paired floating mounts of the edge scissor assemblies and each of the stationary and slide mounts of the supporting members. Because of the stiffness frames of the inner scissor assemblies, it requires much carefulness and larger difficulties in quickly setting up or collapsing the canopy. Besides, the collapsible canopy framework structure needs the operation of the inner scissor assemblies connected to the floating mounts and the operations of the edge scissor assemblies and the articulating sections, which comprises more procedures than that of the conventional canopy framework structure and the configuration of which is complex.

In light of the prior arts described above, it is preferable that the canopy framework structure is simple, easily and rapidly expanded and folded and firmly put in place against the upper compressive force and lateral force that are exerted on upper and side portions.

Accordingly, an object of the invention is to provide a collapsible canopy framework structure of a regular polygon including an upper framework reinforced to effectively support the upper and side loads and to be easily collapsible and expandable.

Another object of the invention is to provide a collapsible canopy framework structure of a regular polygon including a first frame assembly including at least one frame unit for enabling a plurality of supporting members to be expanded out of and collapsible toward a center post and a second frame assembly including at least one unit for enabling supporting members to be moved to be close to or separated far away from each another, so that its upper and sides are reinforced.

Another object of the invention is to provide a collapsible canopy framework structure of a regular polygon for radially enabling a plurality of supporting members to be expanded in three, four, five or seven-sided angular shape with respect to a center post.

SUMMARY OF THE INVENTION

According to the invention, a collapsible canopy framework structure of a regular polygon comprises a plurality of supporting members constituted as a column and including a first fixed mount fastened to the upper end thereof and a first slide mount slidable thereon, which are radially moved outward upon being unfolded and moved toward a center upon being folded; the center post including a second fixed mount fastened to the lower end thereof and a second slid mount slidable thereon; a plurality of first frame assemblies including first and second X-shaped frame units, in which the frame unit includes a pair of frames pivoted at one ends to the first slide mount and at the other ends to the first fixed mounts and pivotally coupled at the center to each another and connects the supporting member to the center post; in which the first frame assembly is mounted between the supporting member and the center post; a plurality of second frame assemblies including at least one X-shaped frame unit pivoted at the center for enabling the supporting members to be moved toward/spaced from each another, in which the X-shaped frame unit includes a pair of frames fixed to the first slide and fixed mounts of the supporting members; and a plurality of block nut structures mounted on the pivoted points of the frame units of the first frame assembly and including a through-hole formed on the center to enable a flexible string to be passed therethrough, thereby providing a tension to an overall structure.

The first frame assembly comprises the first and X-shaped second frame units, in which the first frame unit includes two frames pivoted at the center with one ends being connected to each of the first fixed and slide mounts of the supporting member and the X-shaped second frame unit includes two frames pivoted at the center with one ends being connected to each of the second fixed and slide mounts of the center post and the floating ends of the first and X-shaped second frame units being pivoted at the center to one another. Therefore, the first frame assembly permits the supporting members to be radially moved toward or outward the center post, thereby accomplishing the erection and collapsibility of the collapsible canopy framework structure.

The second frame assembly unit comprises third and fourth frame units including a ball socket block fixed to their ends, in which the ball socket block is ball-jointed through a joint bar to a ball socket of a connecting mount to be slidable on the frames of the first and second frame units adjacent to each of the support member, and floating ends of the third and fourth frame units are pivoted at the center to each another to narrow or widen the gap between them, so that the supporting members are moved to be adjacent to or spaced far away from each another. Therefore, the second frame assembly cooperates with the first frame assembly, so that the canopy framework structure are more easily elected and collapsed in an emergency site.

The flexible strings are arranged in a radial pattern between the supporting member and the center post, passing through the cross-points of the first and second frame units between the supporting members to reinforce the upper of the canopy framework structure. The second frame assembly can keep the gap between the supporting members to reinforce the radial configuration of the canopy framework structure, thereby providing a tension against the upper pressure and lateral force and preventing the twist of the upper portion due to the upper and lateral loads thereof.

BRIEF DESCRIPTION OF THE DRAWINGS

The invention now will be described in detail(ed) with respect to the accompanying drawings, in which.

DETAILED DESCRIPTION OF THE INVENTION

Figure 1A:
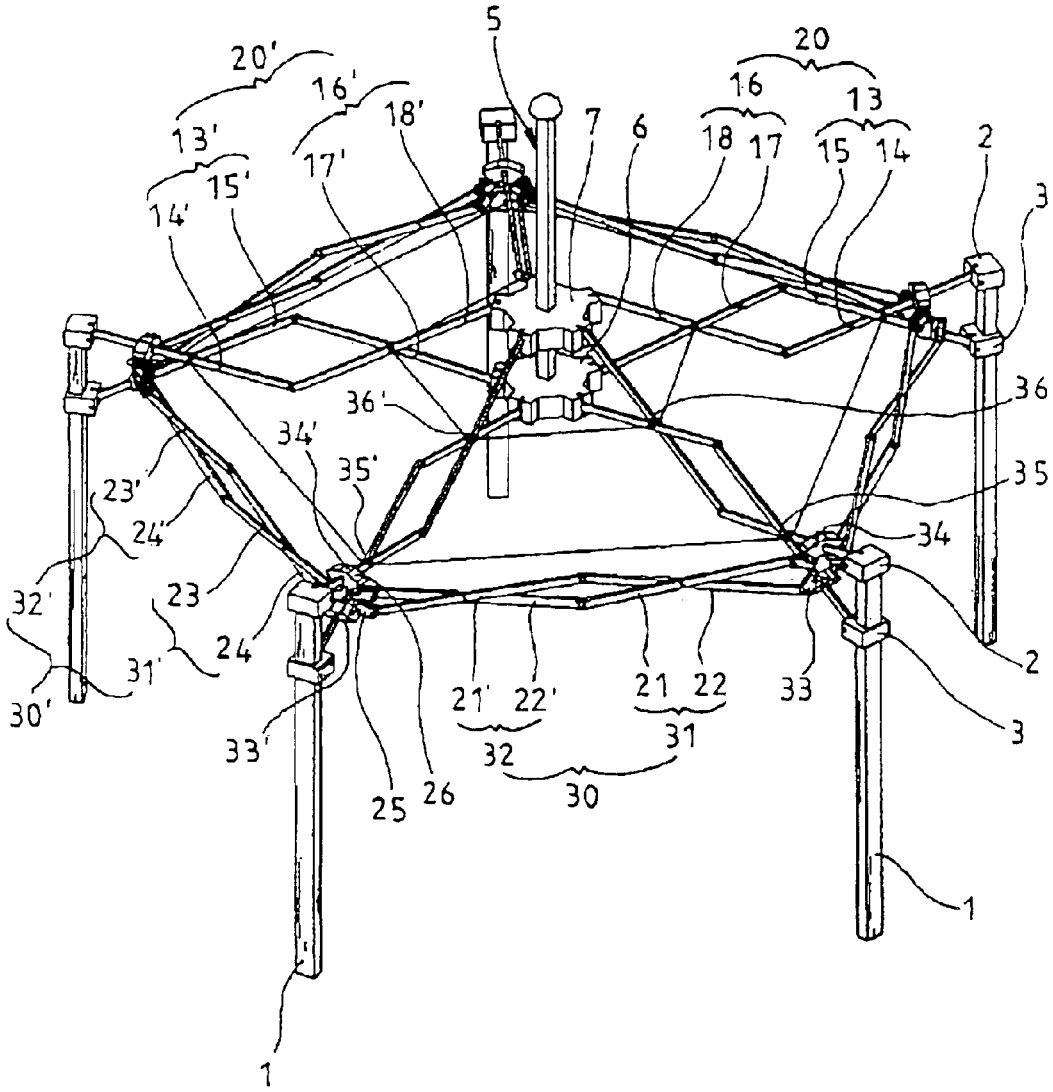
FIG. 1A is a perspective view illustrating the unfolded state of a collapsible canopy framework structure of a regular polygon according to the invention.

Referring to FIG. 1A, a collapsible canopy framework structure of a regular polygon according to the invention comprises a plurality of supporting members 1 constituted as a column to form a regular polygon of three, four, five, six or seven sided portions. The supporting member 1 can be constructed as a telescope structure for adjusting its height, which may be an upper portion of the telescope structure and a single body of a predetermined height.

The supporting member 1 includes a first fixed mount 2 attached to its upper end and a first slide mount 3 slidably mounted to move toward or spaced away from the fixed mount 2 thereon. The fixed and slide mounts 2 and 3 are designed to allow a plurality of frames to be pivoted at one surface thereof, which may be a general configuration. The slide mount 3 is moved along the body of the supporting member 1 and then stopped on a predetermined position. For example, a separate stopper (not shown) is inserted into any one of a plurality of holes formed on the body or a body hole that is corresponded in a straight line passing through a hole formed on the slide mount to position the fixed mount.

The center post 5 is positioned at the center of a plurality of supporting members 1 expanded in a radial arrangement with being floated. Otherwise, it may have a telescoping configuration to function as a center column. In the drawing, the center post 5 is floated to form the center portion of the canopy framework structure. The center post 5 includes a plurality of holes 11 formed in a predetermined interval along its height, a second fixed mount 6 attached to its lower end and a second slide mount 7 inserted onto its body to be slidable.

Figure 2A:
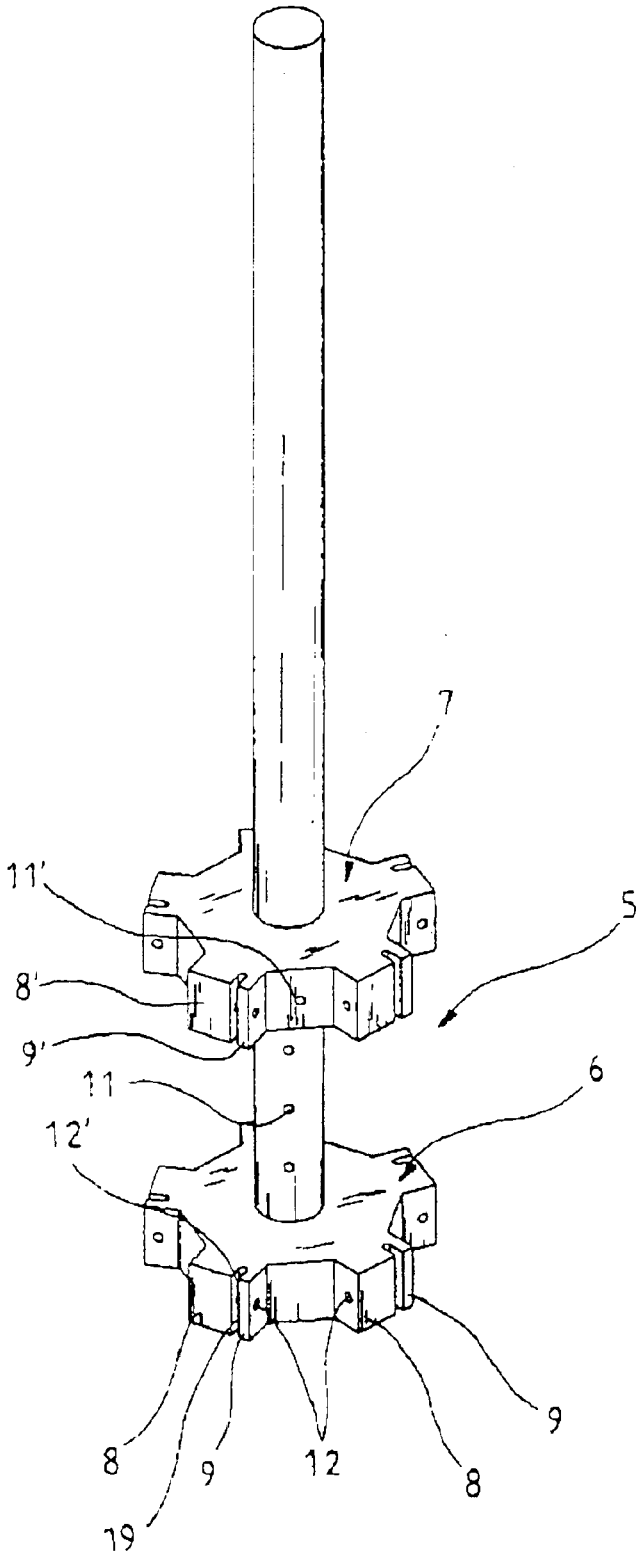
FIG. 2A is a perspective view illustrating a detailed configuration of a center post according to the invention.

As shown in FIG. 2A, the second fixed and slide mounts 6 and 7 have a shape equal to each other and have the same pivot points as the number of the supporting member 1 to form a regular polygon. For example, the second fixed mount 6 includes a pair of wall portions 8 and 9 projected from the circumference thereof to form a space 19 therebetween, in which the space 19 receives the end of the frame having a hole. On the side surfaces of the wall portions 8 and 9, holes 12 and 12' are pierced through to be corresponded to the hole of the frame, in which the hole 12' is a coupling hole to be engaged with a threaded portion formed on the end of a pin (not shown). Therefore, the ends of frames are pivoted between the wall portions by a pin (not shown). The second slide mount 7 has the same configuration as that of the second fixed mount 6, but may include a hole 11' pierced thereon between the wall portions 8' and 9'. The second slide mount 7 is positioned on a predetermined height of the center post 5 by a stopper (not shown) inserted into the hole 11' in comply with the hole 11 of the center post 5 (2).

Referring to FIG. 1A, again, a first frame assembly 20 is mounted between the supporting member 1 and the center post 5 to enable the collapsible canopy framework structure 10 to be expanded, as the supporting members 1 are radially moved outward in an opposite to the center post 5 and to be collapsed, as the supporting members 1 are radially moved toward the center post 5 to be adjacent thereto. The first frame assembly 20 includes a pair of first and second X-shaped frame units 13, 16 and 13', 16'. The first frame units 13 and 13' include two frame 14, 15 and 14', 15', each having one end pivoted to the first fixed and slide mounts 2 and 3 of the supporting member 1 and the other ends floated and are cross-pivoted in a X shape at the center thereof. The second frame units 16 and 16' include two frames 17, 18 and 17', 18' each having one end each pivoted to the second fixed and slide mounts 5 and 6 of the center post 2 and the other ends floated and are cross-pivoted in a X shape at the center thereof. The floating ends of the first and second frame units 13 and 16 are pivoted to each another. Therefore, the first frame assembly 20 allows the space between the supporting member 1 and the center post 2 to be widened and narrowed.

Figure 2B:
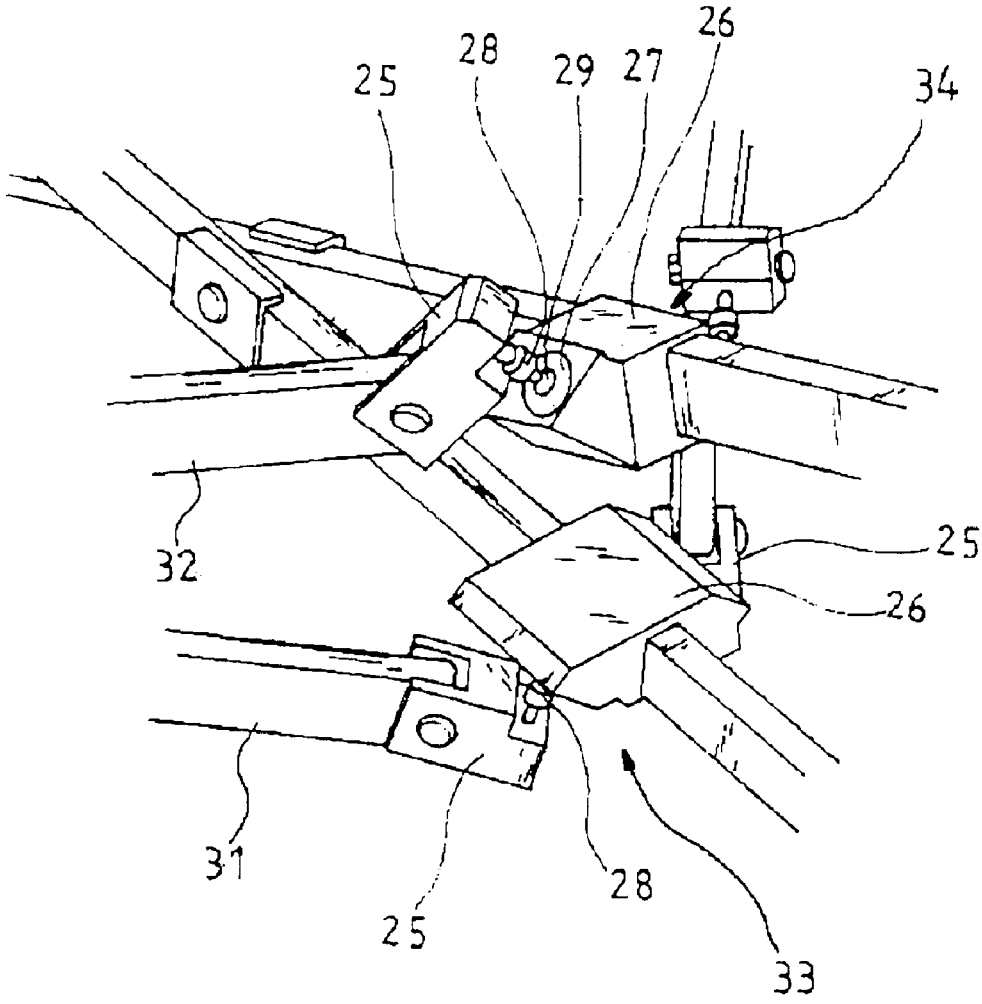
FIG. 2B is a partly expanded perspective view illustrating a detailed configuration of the interconnecting of each of connecting mounts to frame units with each another according to the invention.

A second frame assembly 30 are extended between the supporting members 1 and includes a third frame unit 31 and a fourth frame unit 32, in which the third and fourth frame units 31 and 32 are provided with a pair of frames 21, 22 and 21', 22' crossed at the center in an X shape. Each end of frames 21, 22 and 21', 22' is connected to connecting mounts 33, 34 and 33', 34' which are slidably inserted onto the frames 14, 15 and 14', 15' of the first and second frame units 13 and 13', thereby keeping the interval between the supporting members 1. For it, referring to FIG. 2B, the frames 21, 22 and 21', 22' has a ball socket block 25 including a ball socket 27, which is mounted on the end thereof. The connecting mounts 33, 34 and 33', 34' includes a body 26, on both side surfaces of which the ball socket 27 are respectively mounted. A ball joint bar 28 includes balls 29 integrated on both ends thereof, which is extended between the ball socket 27 of the ball socket block 25 and the ball socket 27 of the connecting mounts 33, 34 and 33', 34'. Therefore, the connecting mounts 33, 34 and 33', 34' enable the third and fourth frame units 31 and 32 to be slidable on the frames 14, 15 and 14', 15' of the first and second frame units 13 and 13'.

Therefore, when the supporting members 1 are moved toward and out of the center post 5 to be unfolded, the first frame units 13 and 13' and the second frame units 16 and 16' are operated to narrow the gaps between their ends, while the third and fourth frame units 31 and 32 are operated to narrow the gap between the frame ends 21, 22 and 21', 22', and the connecting mounts 33, 34 and 33', 34' are moved toward the center post 5 to widen the gap between the supporting members 1 at maximum.

On the contrary, when the supporting members 1 are moved toward the center post 5 to be adjacent to each another, the first and second frame units 13, 13' and 16, 16' are operated to widen the gap between the ends of the frames 33, 34 and 33', 34', and the connecting mounts 33, 34 and 33', 34' are moved outward from the center post 5 to narrow the gap between the supporting members 1 at minimum.

Figure 3:
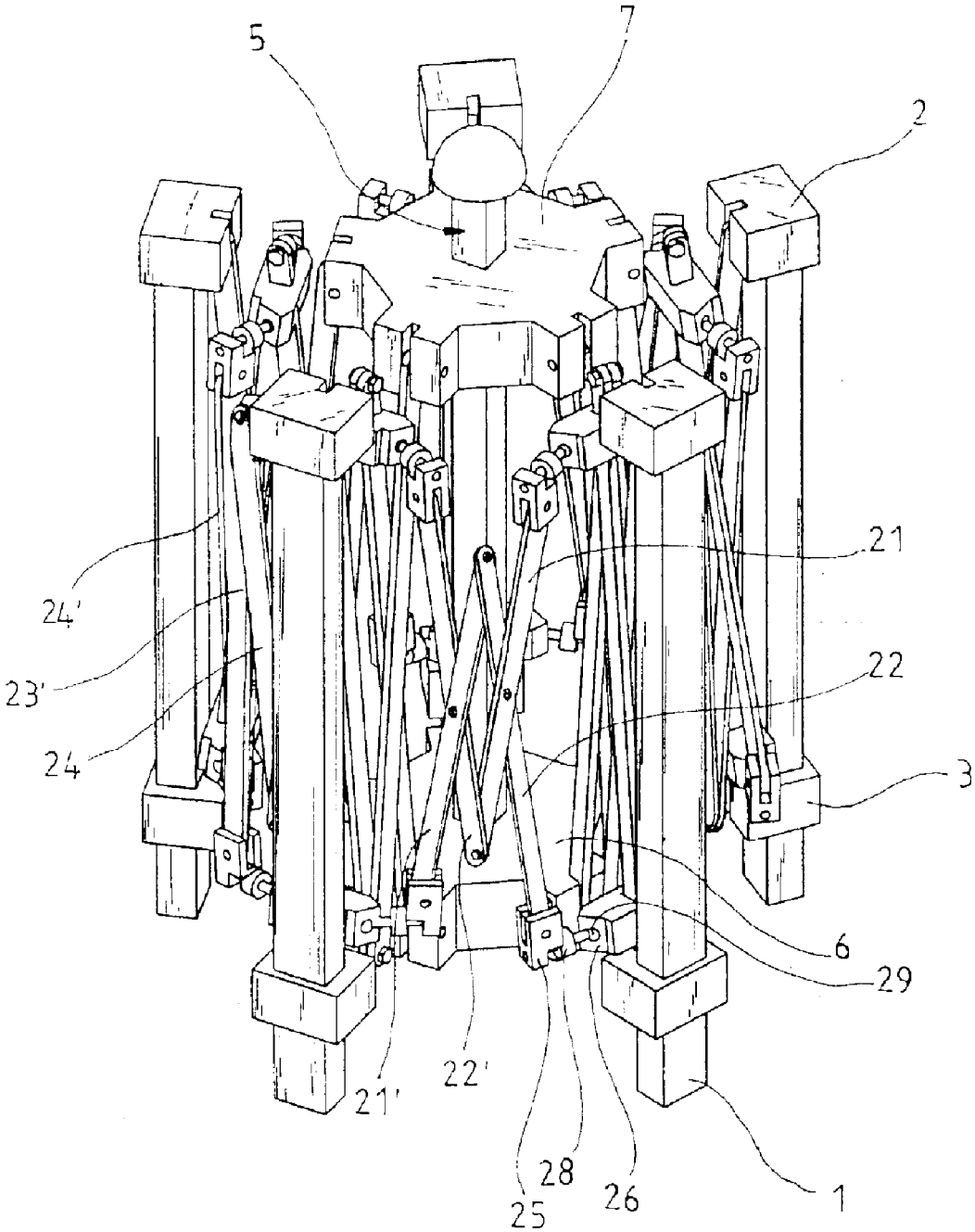
FIG. 3 is a perspective view illustrating the folded state of a collapsible canopy framework structure of a regular polygon according to the invention; and, FIGS. 4A and 4B are exploded and assembled views of a block nut structure to form a X-shaped frame unit according to the invention.

As shown in FIG. 3, the collapsible canopy framework structure of a regular polygon 10 is folded as follows: when the paired first and second frame units 13, 13' and 16, 16' are folded at the same time, the frames 15 and 15' connected at one end to the first slide mount 3 are moved downward, while the second fixed mounts 6 are moved downward with one ends of the frames 17, 17'. At the same time, the second slid mounts 7 are moved upward with the ends of the frames 18, 18'. The floating ends coupled in a pair at the other ends of the frames 14, 15, 17, 18 and 14', 15', 17', 18' get spaced away from each another. Therefore, the first and second frame units 13, 13' and 16, 16' are folded against each another, so that the supporting members 1 and the center post 5 adjoin to each another by narrowing the space therebetween. Therefore, as the first and second frame units 13, 16 and 13', 16' are operated, the third and fourth frame units 31 and 32 are operated to widen the gap between their ends, so that the connecting mounts 33, 34 and 33', 34' are moved toward the supporting members 1 to fold the second frame assemblies 30. In the end, the collapsible canopy framework structure 10 gets collapsed.

On the contrary, as shown in FIGS. 1 and 2, when the paired first and second frame units 13, 16 and 13' and 16' are unfolded, the frames 15, 15' pivoted to the first slide mounts 3 of the supporting member 1 are moved upward, while the second fixed mount 6 of the center post 5 is moved upward with the ends of the frames 17, 17', and the second slid mount 7 is moved downward with the ends of the frames 18 and 18'. And, when the second slid mount 7 is moved downward by the ends of the frames 18, 18', the floating ends of the frames 14, 15, 17, 18 and 14', 15', 17', 18' are adjoined to each another, so that the gaps between the ends of the first and second frame units 13, 13' and 16, 16' are narrowed, thereby widening the gap between the supporting member 1 and the center post 5.

At this time, as the first and second frame units 13, 16 and 13', 16' are operated, the third and fourth frame units 31, 32 and 31', 32' are operated to widen the gap between the ends 21, 22 and 21', 22' of their frames 21, 22 and 21', 22', and the connecting mounts 33, 34 and 33', 34' are moved to be close to the supporting members 1 to fold the second frame assemblies 30, while similar frame assemblies 30' are operated in a similar manner to the second frame assembly. In the end, the collapsible canopy framework structure 10 gets folded.

Herein, it is noted that the second frame assemblies 30 form the upper sides of the collapsible canopy framework structure to keep the gaps between the supporting members 1, the third and fourth frame units of which are extended between the supporting members 1. It increases the force against the upper and lateral loads, thereby preventing the twist of the upper and side portions.

Figure 1B:
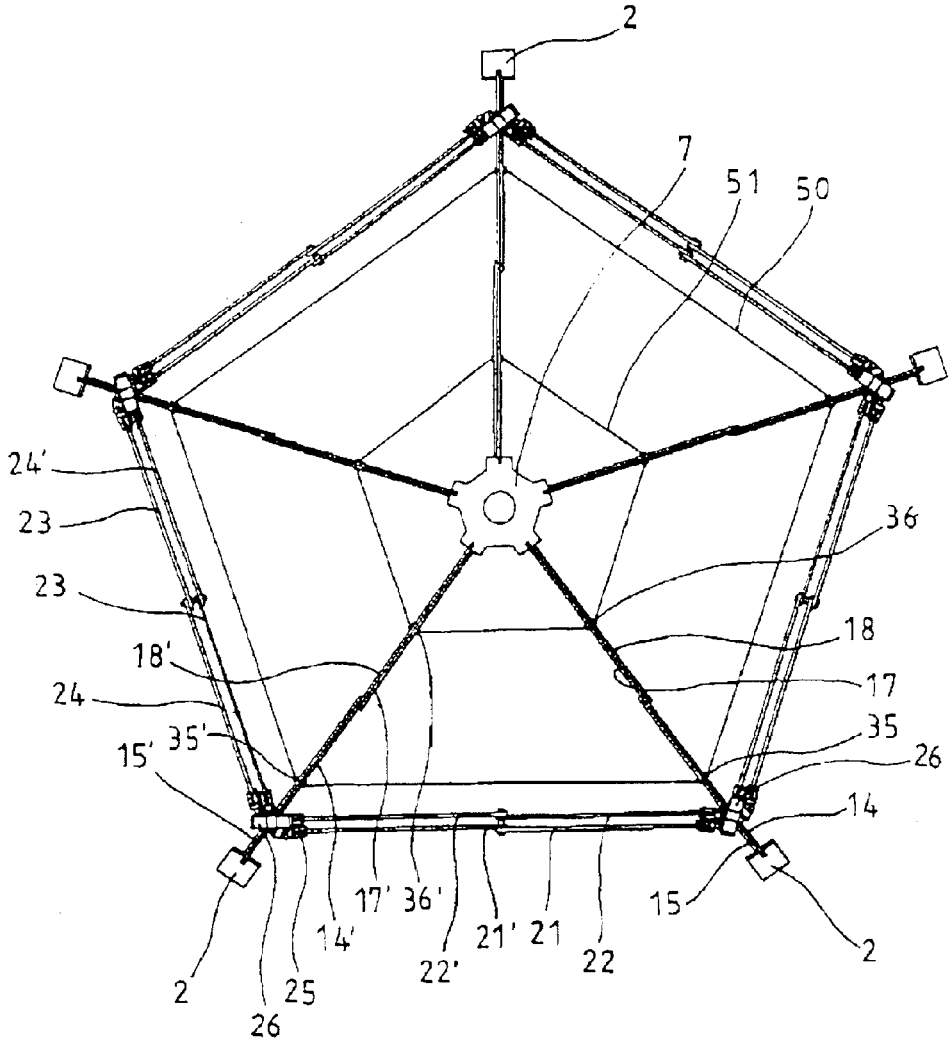
FIG. 1B is a plan view illustrating the unfolded upper portion of a collapsible canopy framework structure of a regular polygon on which at least two flexible strings are mounted.
Figure 4A:
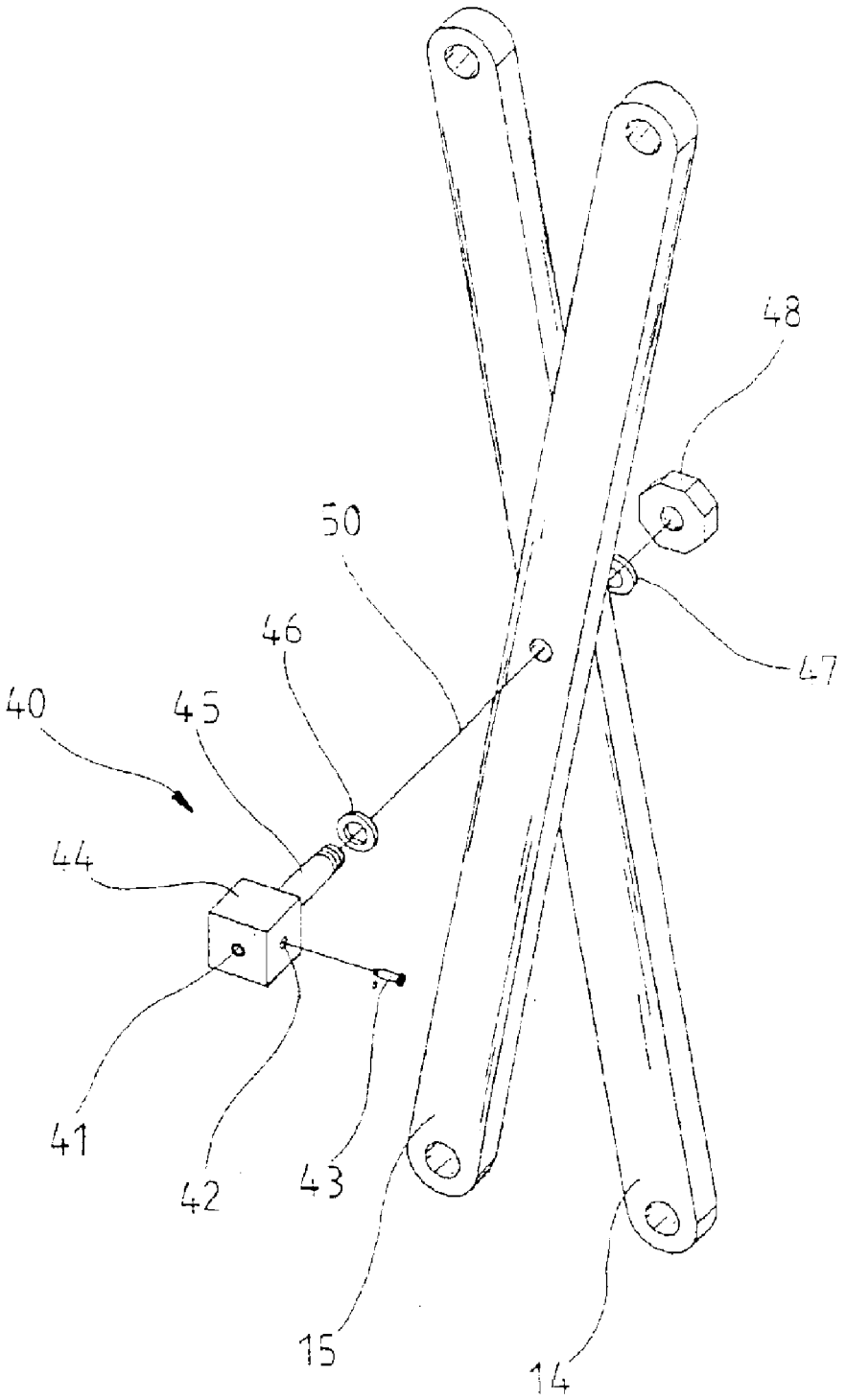
Figure 4B:
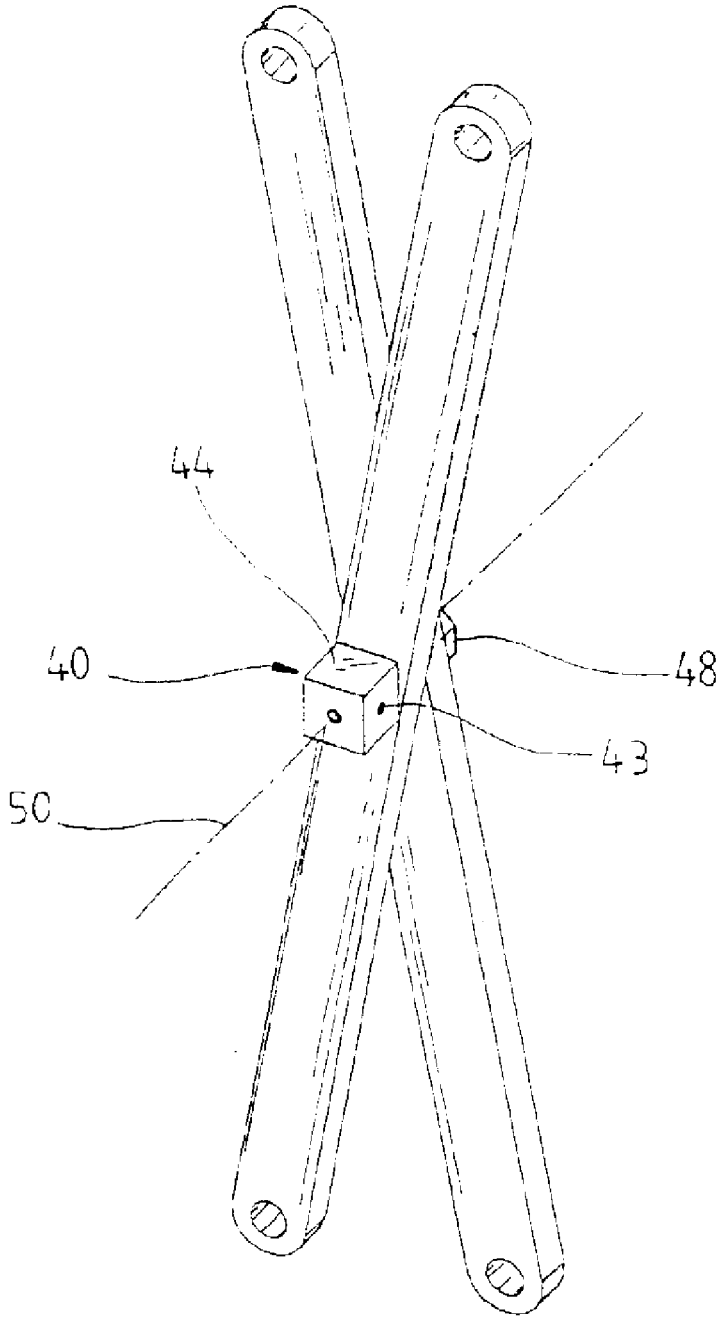

The invention further comprises a flexible string 50 such as a piano string, rope etc. to resist against the upper pressure and the lateral force that may exert on the collapsible canopy framework structure. As shown in FIGS. 4A, 4B and 1B, the flexible strings 50 and 51 are respectively passed through crossing points 35 and 36 of the first and second frame units 13 and 16 and crossing points 35' and 36' of the other first and second frame units 13' and 16' in order. To the end, a block nut structure 40 includes a through-hole 41 pierced at the center to allow the flexible string 50 to be passed therethrough, a head portion 44 having a threaded hole 42 into which a screw 43 is inserted to put the flexible string 50 in place and an extending portion 45 integrally projected from the head portion 44 and having a threaded portion at its end. The block nut structure 40 further comprises nuts 46 and 47 and a screw 48 engaged with the threaded portion 45. In this manner, at least two flexible strings 50 and 51 are radially connected between the crossing-points 35, 35' and 36, 36' of the first and second frame units 13, 13' and 16, 16' to force a plurality of the first frame assemblies 20 provided between the supporting member 1 and the center post 5 to be formed as a regular polygon and then to be separately fixed into the block nut structure 40 by the screw 48, thereby giving a tension between the first frame assembly 20 and the supporting member 1.

Therefore, as shown in FIG. 1B, it is noted that the collapsible canopy framework structure 10 has a new upper supporting portion of a roof type having at least one regular polygon with the flexible strings 50 keeping a tension between the supporting members 1.

As described above, according to the invention, a collapsible canopy framework structure of a regular polygon comprises a plurality of frame assemblies mounted between a supporting member and a center post to be easily folded and unfolded, a plurality of another frame assemblies provided between the supporting members forming the sides thereof to keep the gaps between the supporting members and at least one flexible string passed through the crossing points of frame units of the first frame assemblies to reinforce the side walls, thereby giving a tension between supporting members and between the supporting member and the center post to prevent the twist of an overall structure.

What is claimed is:

1. A collapsible canopy framework structure of a regular polygon, comprising:

a plurality of supporting members constituted as a column and each including a first fixed mount fastened to an upper end thereof and a first slide mount slidable thereon, the plurality of supporting members being radially moveable outward upon being expanded and movable toward a center post upon being folded;

the center post including a second fixed mount fastened to a lower end thereof and a second slid mount slidable along a body thereof, the center portion having an upper portion of a dome type;

a plurality of first frame assemblies including first and second X-shaped frame units, wherein the first and second X-shaped frame units each includes a pair of frames pivotally, each said first frame assembly being mounted at one end to the first slide and fixed mounts and at the other end to the second slide and fixed mounts and pivotally coupled at a center to each other, thereby connecting the respective supporting member to the center post, and wherein the plurality of first frame assemblies are mounted between the plurality of supporting members and the center post;

a plurality of second frame assemblies including at least one X-shaped frame unit pivoted at a center for enabling the plurality of supporting members to be moved toward/spaced from each another, wherein each of the X-shaped frame units includes a pair of frames pivotally connected to the first slide and fixed mounts of respective ones of the plurality of supporting members; and a plurality of block nut structures mounted on the pivot points of the first and second X-shaped frame units of the plurality of first frame assemblies and including a through-hole formed at a center thereof, and a flexible string passed therethrough the through-holes of the block nut structures, thereby providing a tension to an overall structure.

2. The collapsible canopy framework structure of a regular polygon as claimed in claim 1, wherein the first X-shaped frame unit includes two frames pivoted at a center thereof with one end being connected to each of the first fixed and slide mounts of the supporting member and the X-shaped second frame unit includes two frames pivoted at a center thereof with one end being connected to each of the second fixed and slide mounts of the center post, and floating ends of the first and second X-shaped frame units being pivotally connected to one another.

3. The collapsible canopy framework structure of a regular polygon in claimed in claim 1, wherein the at least one X-shaped frame units of the second frame assembly unit comprises third and fourth X-shaped frame units including a ball socket block fixed to their ends, wherein the ball socket block is ball-jointed through a joint bar to a ball socket of a connecting mount configured to be slidable on the frames of the first and second frame units positioned adjacent to each of the plurality of support members, and floating ends of the third and fourth frame units are pivotally connected to one another to narrow or widen a gap therebetween, so that the plurality of supporting members are movable to be adjacent to or spaced far away from each another.

4. The collapsible canopy framework structure of a regular polygon as claimed in claim 1, wherein each of the block nut structures includes the through-hole pierced at the center to allow the flexible string to be passed therethrough, a head portion having a threaded hole into which a screw is inserted to put the flexible string in place and an extending portion integrally projected from the head portion and having a threaded portion at an end thereof.

5. The collapsible canopy framework structure of a regular polygon as claimed in claim 1, wherein the flexible string is arranged in a radial pattern passing through the cross-points of the first and second frame units to secure the radial configuration of the plurality of supporting members and to maintain an interval between the plurality of supporting members.

6. The collapsible canopy framework structure of a regular polygon as claimed in claim 1, wherein the plurality of supporting members and the center post are constructed to be telescoped.

7. The collapsible canopy framework structure of a regular polygon as claimed in claim 3, wherein the connecting mount includes a body having ball sockets mounted on both sides thereof, a ball joint bar having balls integrated on both ends thereof, and end blocks having a ball socket mounted on an end slanting surface thereof.

* * * * *